United States Patent [19]

Kelly

[11] 4,070,819

[45] Jan. 31, 1978

[54] VERTICAL CLOCK

[76] Inventor: Alcuin Kelly, 60 N. Catherine St., Mobile, Ala. 36604

[21] Appl. No.: 717,614

[22] Filed: Aug. 25, 1976

[51] Int. Cl.[2] ..... G04B 45/00

[52] U.S. Cl. ..... 58/2; 58/1 R; 58/45; 58/128; 58/127 R; 58/125 R; 40/473

[58] Field of Search ..... 58/1 R, 2, 45, 125 R, 58/125 B, 125 C, 127 R, 128; 116/114 AJ, 115; 40/28 R, 139, 30, 33

[56] References Cited

U.S. PATENT DOCUMENTS

| | | | |
|---|---|---|---|
| 2,836,912 | 6/1958 | Ranucci | 40/33 X |
| 3,340,633 | 9/1967 | Silberman | 40/33 |

*Primary Examiner*—Ulysses Weldon
*Attorney, Agent, or Firm*—Victor J. Evans & Co.

[57] ABSTRACT

A vertical clock which indicates the time of day from the vertical position of colored cubes rather than from conventional hands on a numbered face. A power source, as an electric clock, has the minute hand removed, and through a gear, movement of the hour hand turns a plate from which there are suspended twelve strings of paper cubes, there being 12 cubes per string. Certain ones of the cubes are appropriately colored to indicate time at a designated position. A pendulum cube, dangling in the center of the others, is driven by the second hand, and it revolves accordingly.

4 Claims, 7 Drawing Figures

FIG. 2.
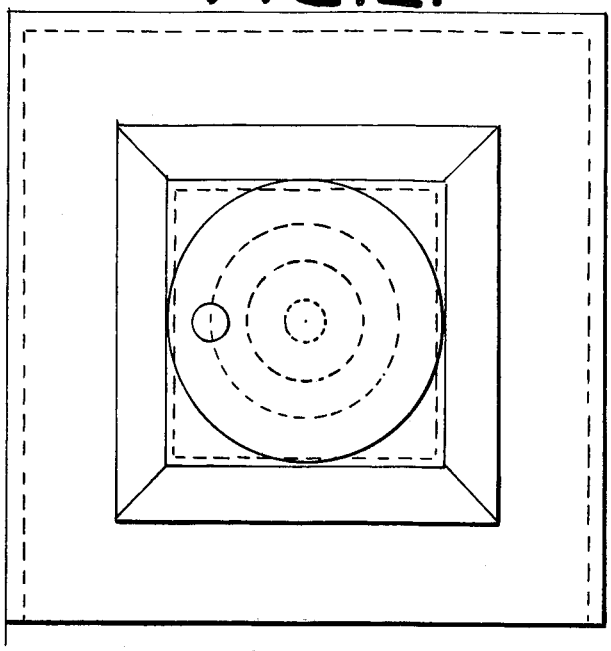
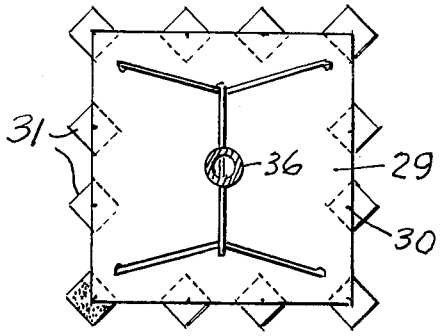
FIG. 4.
FIG. 5.
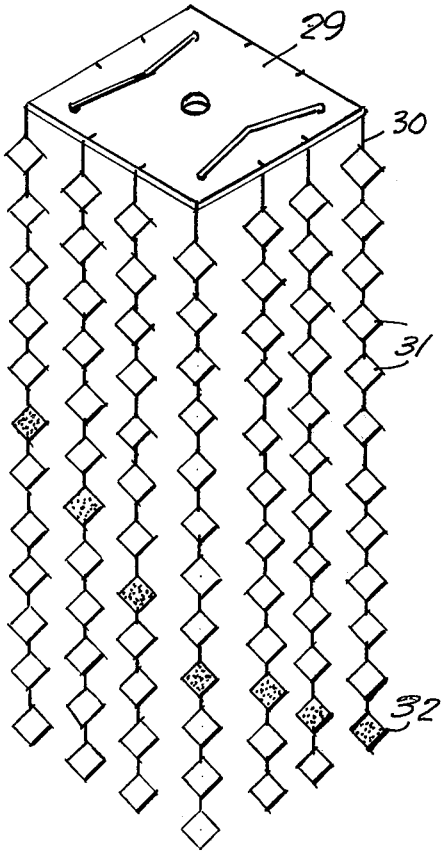
FIG. 3.
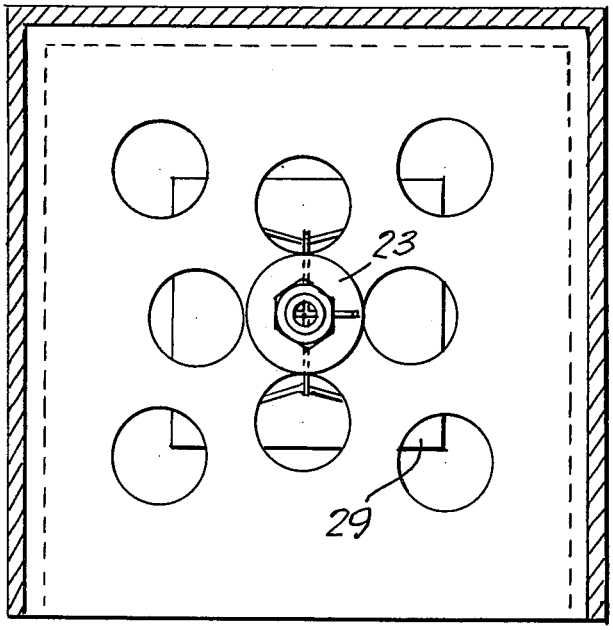

VERTICAL CLOCK

BACKGROUND OF THE INVENTION

Field of the Invention

The present invention relates to a vertical clock.

SUMMARY OF THE INVENTION

The present invention of a vertical clock includes a power source, such as an electric clock, from which the minute hand has been removed, and which includes a gear arrangement to transfer movement of the hour hand to a platform from which are hung vertically 12 strings of paper cubes, with 12 evenly spaced cubes fastened to each of the strings. There is one appropriately colored cube on each string, with the line of colored cubes forming a diagonal stripe across the full set of strings. The strings of cubes slowly rotate under the driving action of the hour hand, with the appropriate colored cube in the front and center position to indicate the hour, and the specific hour being determined by count of the cubes on the string in question by counting from the bottom up to the colored cube. Meantime, a pendulum cube dangles from a string attached to the second hand and revolves once per minute.

The primary object of the invention is to provide a vertical clock, located in a clear plastic standing case, and one which indicates the time through the use of a plurality of vertically suspended colored cubes that are being rotated.

Other objects and advantages will become apparent in the following specification when considered in light of the attached drawings.

BRIEF DESCRIPTION OF THE DRAWINGS

FIG. 2 is a plan view of the top of the invention;

FIG. 3 is a view taken along the line 3—3 of FIG. 1;

FIG. 4 is a view taken along the line 4—4 of FIG. 1;

FIG. 5 is a perspective view of the plate and mounting arrangement of the strings of cubes;

DESCRIPTION OF THE PREFERRED EMBODIMENT

Figure 1:
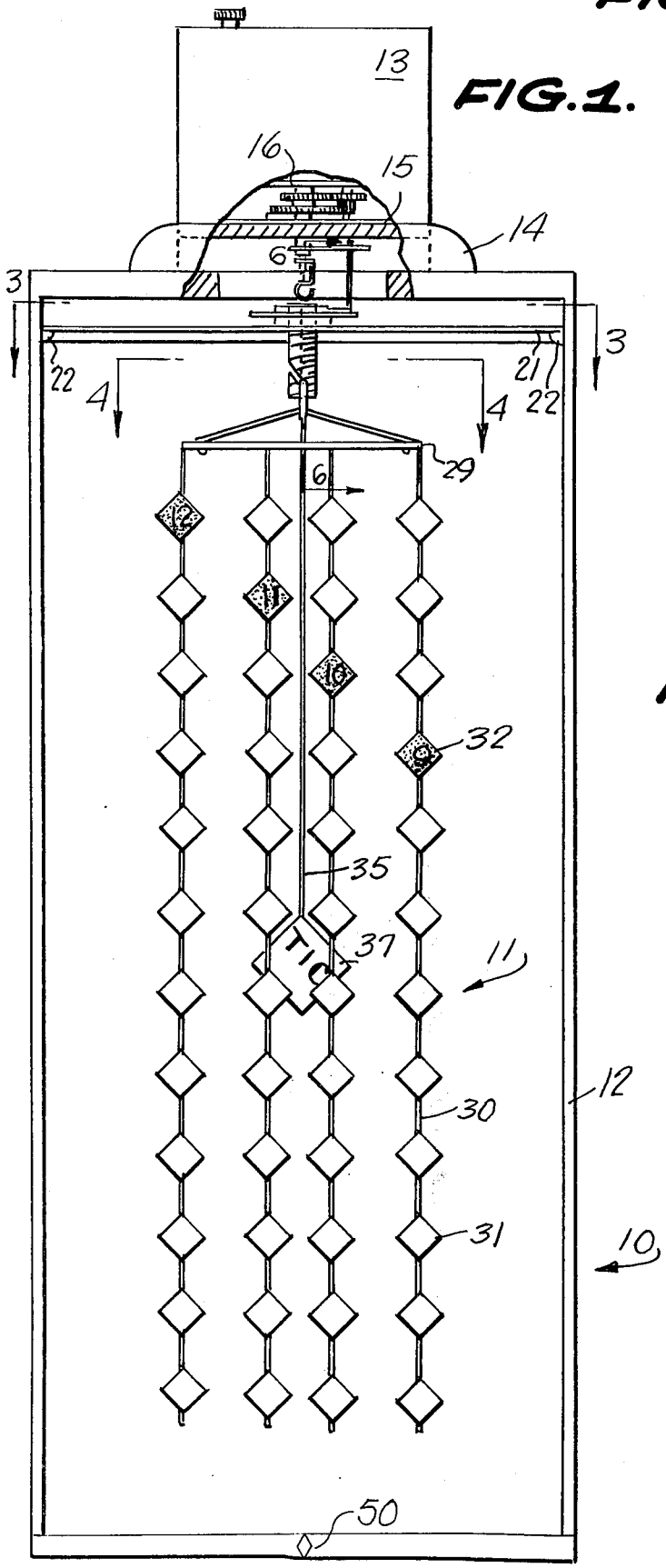
FIG. 1 is a front elevation of the invention showing the suspended cubes.
Figure 6:
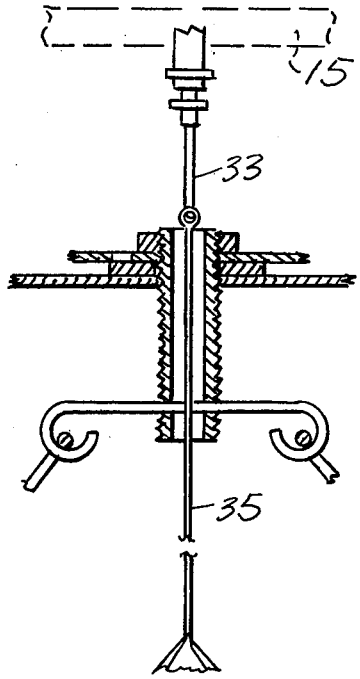
FIG. 6 is a view taken along the line 6—6 of FIG. 1.

Referring now to the drawings in detail, wherein like reference characters indicate like parts throughout the several figures, the reference numeral 10 indicates generally a vertically orientated clock incorporating a plurality of vertically suspended strings of paper cubes, indicated generally at 11.

The clock 10 includes a case 12 which may be of any desired height, but which is composed of a clear, see-through material such as glass or clear plastic so as to render the suspended strings 11 visible to a near by observer.

On top of case 12 there is a housing 13, having a quarter-round flange 14, so that housing 13 rests securely and evenly on top of big case 12. Across the lower part of housing 13 there is a dividing partition 15 which serves as a support for the electric clock works 16 that will drive the suspended strings 11.

Projecting through a hole in partition 15 there extends the time shafts from the electric clock 16, but the normal hands of the clock have been removed. Onto the hour shaft 17 of works 16 there is fastened a short horizontal bar 18, this bar 18 pushes near its outer end the L-shaped bracket 19, and the curved bottom end of bracket 19 being cemented to a disk 20.

Across the top of case 12, and mounted within its walls, there is a shelf 21 which rests on quarter-round supports 22. As will be described hereinafter, the shelf 21 serves a real purpose in that it fully supports the suspended strings and cubes without putting any weight on the electric clock works 16. Extending through shelf 21 there is a cylindrical lamp rod segment 23 that has at its upper end, and above disk 20, a lock washer 24. Below disk 20, and firmly fastened to shelf 21 there is a washer 25, and cylindrical segment 23 extends through and freely turns through, washer 25. Also through the disk 20 there is a hole 26 which serves as an entrance for powdered graphite. Since it was pointed out above that the L-shaped bracket 19 was firmly attached to disk 20, it is obvious that as the bracket 19 rotates pushed by bar 18 then it in turn rotates disk 20, and because washer 25 is fixed to shelf 21, then disk 20 rides on washer 25 as the disk 20 turns, with adequate graphite powder being admitted through hole 26 to lubricate the parts. Then, cylindrical segment 23 is also fixed to disk 20 through the action of lock washer 24, so segment 23 likewise rotates when disk 20 rotates.

Near the lower end of cylindrical segment 23 there is cut a downwardly slanting slot 27 into which is hung a sling arrangement 28, this sling being attached to and serving as a support for a square plate 29. Around the outer periphery of plate 29 there are tied a plurality of downwardly hanging strings 30. These hanging strings are spaced on the periphery according to the 30° radial lines fanning outward from the center of plate 29 to the periphery. It may be clearly seen from FIGS. 4 and 5 that there is a string at each corner of plate 29 and two more attached to each side so that there is a total of twelve strings all together.

Attached to each of the strings 30 there are a plurality of light weight, paper devices or cubes 31. These devices could be in any of several shapes, such as small balls, etc., although cubes seem to be the most desirable, but most important, as will be observed from the figures, it is imperative that there be a total of twelve of these cubes, evenly spaced, on each of the strings. Furthermore, of the twelve cubes on each string there will be one cube which is colored, as at 32, the particular cube which is colored on each string being a different height, or number, from that on any of the other strings.

Figure 7:
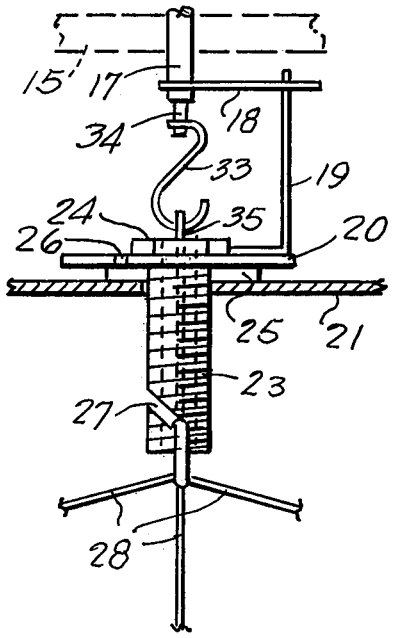
FIG. 7 is an enlarged view of the arrangement for rotating the strings of cubes and the pendulum cube.

As pointed out earlier in the disclosure, the normal clock hands have been removed from the face of works 16, and a short horizontal bar 18 is attached to the hour shaft 17 so that the bar turns at an hourly rate. Now, from FIGS. 1 and 7, it can be seen that an S-shaped connection 33 has been attached to the second shaft 34, and this S-shaped connection 33 has a string 35 hanging from its lower end.

Since cylindrical lamp rod segment 23 is hollow, and also since there is a hole 36 in the center of square plate 29, the string 35 can hand directly down and be located basically in the center of the twelve hour strings 30. A marker, or pendulum, 37 is fastened to the lower end of string 35 and may be marked as Tic-Toc or with any other desirable indicia. The string 35, being attached to second shaft 34 of the clock works, will constantly revolve when the clock is running, and therefore indicia 37 will constantly rotate accordingly.

In the use and operation of the invention, when the vertical clock 10 is plugged into a power source, and the clock works 16 are in operation, the hour shaft 17 of the clock turns and by means of linkage elements 18 and 19 the disk 20 also turns. Disk 20 being fastened to cylindrical segment 23, this component turns square plate 29 so that the strings 30 likewise turn to move the appropriate colored cube 32 into a front and center position 50 in the box 12 to indicate the hour. The specific hour is determined by count of the cubes 31 of the string in question, by counting from the bottom, up to the particular colored cube 32 on that specific string.

The pendulum, or marker cube 37, dangles from a string fastened to S-shaped connection 33, which in turn is attached to second shaft 34 of works 16, and therefore marker cube 37 revolves steadily according to second timing. Cube 37 may be labelled "Tic-Toc" on opposite surfaces.

The vertical clock of the present invention can be disassembled in its major parts, easily. The power source 16 lifts free of the flange 14 and from the linkage 18 and 19, and is easily replaced. The pendulum 37 detaches from connection 33 and from second shaft 34. The square plate 29 with the cube cage lifts out of slot 27.

The shelf 21 rests on quarter round supports 22 and can be raised upwardly with pads, for finer adjustment with the hour hand connection.

There are three visual motions apparent when the device is operating:

1. the revolving pendulum;
2. the hourly positioning of the colored cube;
3. a bellows-like movement which results from the cube cage being alternately square in the box and catercornered in the box.

These motions and the wide scope of possible color codings can make the vertical clock an aesthetic experience while at the same time it is a practical time piece.

Having thus described the preferred embodiment of the invention it should be understood that numerous structural modifications and adaptations may be resorted to without departing from the spirit of the invention.

What is claimed is:

1. A vertical clock comprising an elongated case, clock works positioned on top of the case having an hour shaft eminating centrally downward therefrom, a linkage attached to the hour shaft of the clock works, a square plate connected to the linkage and rotated according to the rotation of the hour shaft, and twelve strings hanging from the periphery of the square plate such that radial lines extending from points where the strings hang from the periphery of the square plate to the center of the square plate define equal included angles and each string is provided on its depending portion with cubes consecutively representing one to twelve so that time may be observed from a referance point remote therefrom.

2. The device of claim 1 wherein there are twelve evenly spaced paper cubes fastened along each of the hanging strings.

3. The device of claim 2 wherein there is one colored paper cube on each hanging string of cubes, the location of each colored cube being at a different position along the length of the string from the position of the other colored cubes on the other strings.

4. The device of claim 3 further including a second shaft of the clock works eminating centrally downward from and concentric to said hour shaft having a string depending therefrom, and indicia attached to the lower end of the string, said string passing through a central hole in the square plate so that the indicia is surrounded by the strings of cubes and rotates at the same speed as the second shaft of the clock works.

* * * * *